US011508565B2

(12) United States Patent
Wang et al.

(10) Patent No.: US 11,508,565 B2
(45) Date of Patent: Nov. 22, 2022

(54) ION GUIDE DEVICE AND ION GUIDE METHOD

(71) Applicant: Shimadzu Corporation, Kyoto (JP)

(72) Inventors: Keke Wang, Shanghai (CN); Xiaoqiang Zhang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/393,507

(22) Filed: Aug. 4, 2021

(65) Prior Publication Data

US 2022/0102128 A1 Mar. 31, 2022

(30) Foreign Application Priority Data

Sep. 29, 2020 (CN) ..... 202011052487.X

(51) Int. Cl.
*H01J 49/06* (2006.01)
*H01J 49/02* (2006.01)

(52) U.S. Cl.
CPC ..... *H01J 49/065* (2013.01); *H01J 49/022* (2013.01); *H01J 49/063* (2013.01)

(58) Field of Classification Search
CPC ..... H01J 49/065; H01J 49/022; H01J 49/063
See application file for complete search history.

(56) References Cited

U.S. PATENT DOCUMENTS

| | | | |
|---|---|---|---|
| 5,179,278 | A | 1/1993 | Douglas |
| 5,572,035 | A | 11/1996 | Franzen |
| 6,107,628 | A | 8/2000 | Smith et al. |
| 7,095,013 | B2 | 8/2006 | Bateman et al. |
| 2011/0049357 | A1 | 3/2011 | Giles |

FOREIGN PATENT DOCUMENTS

| | | | |
|---|---|---|---|
| CN | 103515183 | A | 1/2014 |

*Primary Examiner* — Nicole M Ippolito
*Assistant Examiner* — Hanway Chang
(74) *Attorney, Agent, or Firm* — Locke Lord LLP; Tim Tingkang Xia, Esq.

(57) ABSTRACT

An ion guide device includes a plurality of ring electrodes disposed in parallel, wherein each ring electrode includes at least 4 electrode units separated from each other, a channel for ion transmission is formed inside the plurality of ring electrodes, and an arrangement direction of the plurality of ring electrodes defines an axial direction of ion transmission; an radio-frequency voltage source, for applying out-of-phase radio-frequency voltages on the neighboring electrode units belonging to the same ring electrode, and applying in-phase radio frequency voltages on a neighboring electrode units along the axial direction, thereby forming an radio-frequency multipole field that confine ions in the ion guide device; and a direct-current voltage source, wherein the ions are transmitted off-axis and focused to a position closer to an inner surface of the ring electrode under a combined action of the radio-frequency voltage and the direct-current voltage.

13 Claims, 8 Drawing Sheets

ION GUIDE DEVICE AND ION GUIDE METHOD

CROSS-REFERENCE TO RELATED PATENT APPLICATION

This application claims priority to and the benefit of Chinese Patent Application Serial No. 202011052487.X, filed Sep. 29, 2020, which is incorporated herein in its entirety by reference.

TECHNICAL FIELD

The present invention relates to the technical field of ion guide, and in particularly to an ion guide device and an ion guide method.

BACKGROUND ART

In a mass spectrometer, an ion guide device is usually required to achieve low-loss transmission of ions from a high-pressure ion source region (1 to $10^5$ Pa) to a low-pressure ion analyzer zone (<1 Pa) in addition to necessary vacuum interfaces. The ion guide device is generally composed of a series of electrodes applied with an radio-frequency voltage. The radio-frequency voltage forms an potential barrier around a central axis of the device to confine and focus ions. At the same time, the ions directionally move to a next stage of vacuum driven by a gas flow due to differential pumping or an additional direct-current electric field along the axis, and then the ions are analyzed by a mass analyzer.

Earlier radio-frequency ion guide devices, such as a multipole ion guide system (U.S. Pat. No. 5,179,278) invented by D. J. Douglas, and a surface-reflective multipole field guide device (U.S. Pat. No. 5,572,035) proposed by J. Franzen, can focus ions at 0.1 torr. Then, a Q-array ion guide device invented by N. Inatsugu and H. Waki, and a traveling wave ion guide device (U.S. Pat. No. 7,095,013) proposed by Bateman et al., and the like, can better guide and focus ions at a pressure below 5 torr. In order to focus ions at higher pressures, an ion funnel device (U.S. Pat. No. 6,107,628) was proposed by R. D. Smith to transmit and focus ions efficiently at a pressure near 30 torr, which greatly increases sensitivity of the device.

However, when an ion funnel is applied to a mass spectrometer, there was a capillary or a sampling cone structure with small hole in a pre-stage of the ion funnel to connect to an atmospheric pressure, while the pressure of a latter stage of the ion funnel is lower than the pressure of the ion funnel. Due to the funnel-like structure, a strong gas flow exists across an entire axis of the funnel, and a large gas flow also exists at an outlet even a metal jet-disrupter is added near an inlet of the funnel to reduce the gas flow. This gas flow not only increase the load of a vacuum pump, these neutral gas molecules also can bring noise to the ion detection; in particular, when matched with an electrospray ion source, the gas flow carries charged droplets that have not been completely desolvated to enter the next stage of vacuum, thereby bringing more noise and affecting sensitivity of an instrument.

K. Giles designed an off-axis ion guide device in U.S. Patent No. US2011/0049357. The device comprise a large and a small barrel-shaped electrode arrays, and there is a potential barrier between the two arrays. Ions enter the large-barrel electrode array from one side of the device, then overcome the barrier between the arrays under a direct-current electric field, and enter the small-barrel electrode array for transmission and extraction, while neutral molecules are extracted along an axis of the large-barrel electrode array, so as to achieve off-axis transmission of ions. The device has two disadvantages, one of which is ineffective ion focusing. A radius of an ion beam after the device is determined by a radius of the small-barrel electrode array. However, when the radius of the small-barrel electrode is too small, an radio-frequency barrier at an edge connecting with the large-barrel electrode becomes strong, which is difficult for the ions to enter the small-barrel electrode array. The second disadvantage is that the structure of the device is complex, so that it is difficult to manufacture.

In patent CN103515183A, Zhang et al. discloses an off-axis ion guide device, comprising a plurality of ring electrodes arranged in parallel, in which each ring electrode comprise a plurality of discrete segmented electrodes. A power source device applies an radio-frequency voltage on the ring electrode, the radio-frequency voltage applied on the adjacent segmented electrodes of the same ring electrode has different phases, and the radio-frequency voltage applied on the adjacent segmented electrodes along a central axis also has different phases. The radio-frequency voltage applied on adjacent segmented electrodes along the central axis is used to focus the ions, and specifically, a balance between this radio-frequency voltage and a direct-current voltage focuses the ions at an inner side of the ion guide device. This device is simple in structure and easy to manufacture. However, this kind of radio-frequency voltage having different phases that is applied on adjacent segmented electrodes along the central axis may result in oscillations of the ions near the inner surface of the device, which causes the ions to be heated and dissociated and leads to lower ion transmission efficiency.

SUMMARY OF THE INVENTION

The present invention is proposed in view of the above technical problems, and aims to provide an ion guide device and an ion guide method for off-axis transmission ions, so that it is possible to avoid or mitigate an ion-heating problem caused by an radio-frequency multipole field when ions are confined to an inner surface of the ion guide device, thereby avoiding unexpected dissociation phenomena and improving ion transmission efficiency.

One aspect of the present invention provides an ion guide device, including: a plurality of ring electrodes disposed in parallel, each ring electrode includes at least 4 electrode units separated from each other, a channel for ion transmission is formed inside the plurality of ring electrodes, and an arrangement direction of the plurality of ring electrodes defines an axial direction of ion transmission; an radio-frequency voltage source used to apply out-of-phase radio-frequency voltages to adjacent electrode units belonging to the same ring electrode, and apply in-phase radio-frequency voltages on adjacent electrode units in the axial direction, thereby forming an ion-confine radio-frequency multipole field in the ion guide device; and a direct-current voltage source used to apply direct-current voltages to the plurality of ring electrodes, a direct-current voltage has a first direct-current component having amplitude that changing in an axial direction and a second direct-current component having amplitude that changing in a predetermined direction along a plane of the ring electrode; in which the ions are transmitted off-axis and focused to a position closer to an inner surface of the ring electrode under a combined action of the radio-frequency voltages and the direct-current voltages.

With the number of electrode units on the same ring electrode increasing, the electrode units are more densely distributed, and thus spacing between adjacent electrodes becomes shorter. With the lengths of adjacent electrode units decreasing, after adaptively applying radio-frequency voltages, the ions beam is confined and focused in smaller size by the radio-frequency multipole field.

When radio-frequency voltages are applied to adjacent electrode units belonging to the same ring electrode, the ions can be confined more effectively within the channel during ion transmission. Further, a balance between the above-mentioned radio-frequency voltage and the second direct-current component of the direct-current voltage can be utilized to focus the ions near the inner surface of the ring electrode. Since the radio-frequency voltage as one factor of focusing balance described above is an radio-frequency voltage applied to adjacent electrode units of the same ring electrode, an application mode of the radio-frequency voltages can avoid or mitigate an oscillation heating problem during ion transmission, thereby avoiding unexpected dissociation phenomena and improving ion transmission efficiency.

Herein, term "ring electrode" merely attempts to limit a hollow structure of an electrode, and does not attempt to limit an overall outline shape of the electrode. Specifically, an outer ring outline of the ring electrode can be square, circular, polygonal, or any other suitable shape and a combination of shapes. An inner ring outline of the ring electrode may be consistent with or correspond to the outer ring outline, and may not be consistent with or not correspond to the outer ring outline. For example, a "ring electrode" may be a ring electrode having a circular outer ring outline and a square inner ring outline.

Herein, term "predetermined direction" can be a direction that is previously specified, such as a direction specified by a structure of the ring electrode. For example, in some technical embodiments, a structure or a segmented mode itself of the ring electrode has some directionality, and the directionality can be used to define an application direction of the second direct-current component. Furthermore, the term "predetermined direction" can also be a direction specified by the direct-current voltage source. For example, in some technical embodiments, a structure or a segmented manner of a ring electrode is in a centrosymmetric or a rotationally symmetric form, which itself does not have directivity on a radial plane, and the second direct-current component of the direct-current voltage source can be applied in any direction. In these technical embodiments, the "predetermined direction" is defined by the application direction of the second direct-current component that is pre-stored or temporarily generated by the direct-current voltage source.

In one preferred technical embodiment of the present invention, the shape of the ring electrode has at least one interior angle, and the predetermined direction points to the interior angle. Electrodes at two adjacent sides, as compared to a location of a side or a location of a smooth curve, that form an interior angle can provide an radio-frequency multipole field that compresses an ion beam from both sides to the middle, thereby increasing a focusing effect of the ion beam.

Further, in one preferred technical embodiment of the present invention, the interior angle is an inferior angle of 30° to 150°. The interior angle is an inferior angle, which can effectively provide an radio-frequency multipole field that compresses the ion beam from both sides to the middle. A size of the interior angle should not be too large or too small. Since a large interior angle easily leads to reduced compression performance of the ion beam while a small interior angle is difficult to perform stable off-axis transmission on the ion beam to a preset ion outlet position, the interior angle is set as 30° to 150°, which can effectively take the above problems into account.

In a preferred technical embodiment of the present invention, the radio-frequency multipole field extends in the axial direction inside the plurality of ring electrodes. The "radio-frequency multipole field extends in the axial direction" refers to that the entire radio-frequency multipole field basically extends in the axial direction. Since the entire radio-frequency multipole field basically extends in the axial direction, an ion transmission in the axial direction is relatively smooth, which can more effectively mitigate the oscillation heating problem of the ions during the transmission.

In a preferred technical embodiment of the present invention, the ring electrode has a plurality of electrode units with the same length. Using electrode units with the same length to form the ring electrode, on the one hand, can improve the universality of production and assembly of ring electrode components, and on the other hand, can also simplify simulation or calculation of the electric field to be applied.

In a preferred technical embodiment of the present invention, the length of each electrode unit in each ring electrode gradually decreases in a predetermined direction.

In addition to the electrode units at the corners, the confine performance of the electrode units to the ion beam can be adaptively set by configuring the length of each electrode unit of the ring electrode to gradually decrease in the predetermined direction. The electrode unit closer to a starting end in the predetermined direction tends to have a longer length, and can generate medium-long range repulsion, which keeps the ions at positions close to the central axis so as to facilitate performing further confine and focusing on the ion beam by pushing the ions from both sides to the middle. The electrode unit closer to a tail end in the predetermined direction tends to have a shorter length, and a shorter electrode unit can confine the ions in close vicinity so as to compress the ion beam to a much smaller size and improve the transmission efficiency of the ion beam by pushing the ions from both sides to the middle. In some more preferred technical embodiments, a compression ability of the ring electrode toward the ion beam can be further improved by configuring the tail end of the ring electrode in the predetermined direction as the interior angle of the ring electrode.

In one preferred technical embodiment of the present invention, the plurality of ring electrodes has the same shape and size. Uniform structure and size of each ring electrode can facilitate manufacturing ring electrodes and applying voltages.

In one preferred technical embodiment of the present invention, the ring electrode is a metal portion manufactured on a circuit board. On the one hand, using the circuit board structure to manufacture and assemble the ion guide device can conveniently and regularly reserve wiring for each electrode unit; on the other hand, a circuit board process or a golden finger process is mature and can be used to obtain a smooth electrode unit with an unfirm thickness, thereby improving uniformity of the formed electric field.

In one preferred technical embodiment of the present invention, each ring electrode is manufactured on one or more circuit boards. Optionally, obtaining the ring electrode by assembling a plurality of circuit boards can omit circuit board structures in some positions and save the use of materials.

In one preferred technical embodiment of the present invention, the circuit board includes at least one gap for gas circulation. In manufacturing or assembling the circuit board, a path is provided for the gas circulation by reserving the gap, and this configuration can allow the ion guide device to have a more compact and regular structure.

REFERENCE NUMERALS

1—ion guide device; 10, 11, 12, 20—ring electrode; 101, 102, 103, 104, 105—electrode unit; 2—ion guide device; 21—ion inlet; 22—ion outlet; 201—first side; 202—second side; 203—third side; 204—fourth side; 205, 206, 207, 208, 209, 210, 211—electrode unit; 212—interior angle; 3—circuit board; 302—notch; 402—second side; 404—fourth side; 405—electrode unit; radio-frequency-radio frequency voltage source; direct-current-direct current voltage source.

DETAILED DESCRIPTION OF PREFERRED EMBODIMENTS

The present invention will be further described in detail below with reference to the accompanying drawings.

In descriptions of the present invention, it should be understood that an orientation or positional relationship indicated by terms "upper", "lower", "front", "rear", "left", "right", "top", "bottom", "inner", "outer" and the like is an orientation or positional relationship based on the drawings. It is only for the convenience of describing the present invention and simplifying the description rather than indicating or implying that the device or element referred to must have a specific orientation and should be constructed and operated in a specific orientation, which should not be construed as limiting the present invention.

First Embodiment

Figure 1:
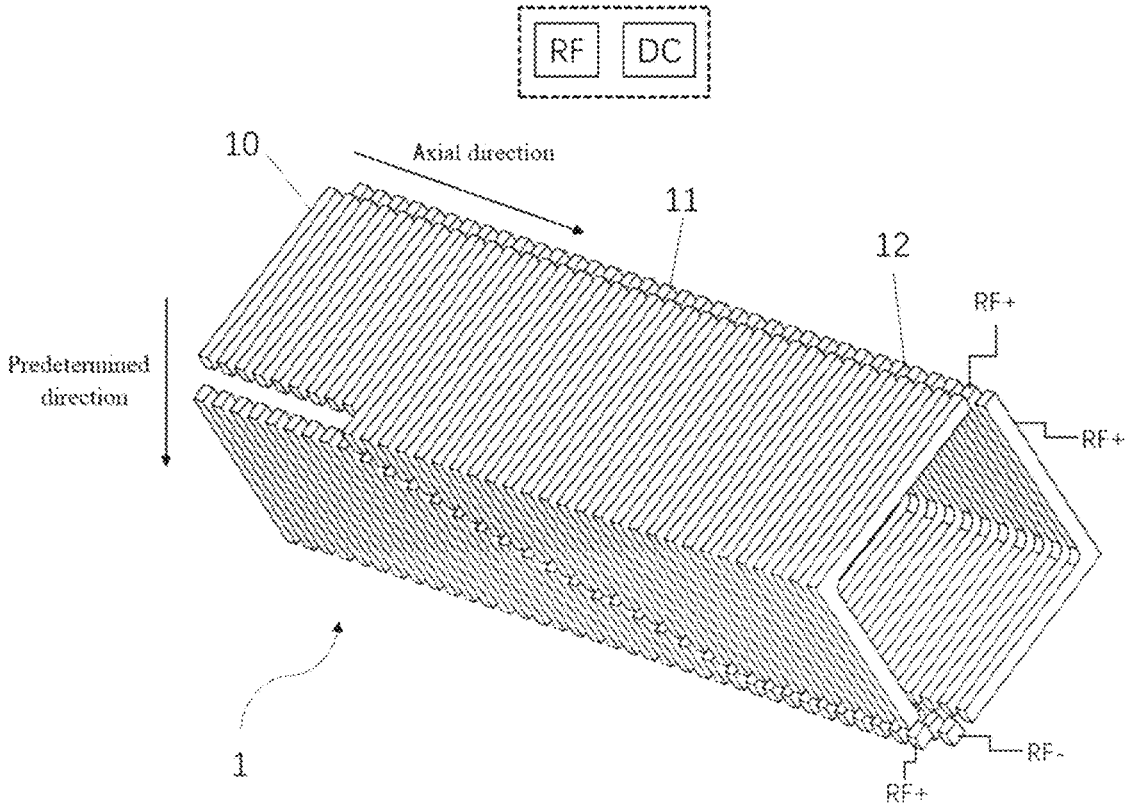
FIG. 1 is a schematic structural view of an ion guide device according to a first embodiment of the present invention.

Referring to FIG. 1, the present embodiment provides an ion guide device 1 including a plurality of ring electrodes 10, 11, and 12 that are placed in parallel with each other.

Each ring electrode 10, 11, and 12 includes 4 electrode units 101, 102, 103, and 104 separated from each other, a channel for ion transmission is formed inside the plurality of ring electrodes 10, 11, and 12, and an arrangement direction of the plurality of ring electrodes 10, 11, and 12 defines an axial direction of ion transmission.

The plurality of ring electrodes 10, 11, and 12 can be coaxial or not. The arrangement direction of the plurality of ring electrodes 10, 11, and 12 is a direction formed by connecting centers of each of the ring electrodes 10, 11, and 12; when the ring electrodes 10, 11, and 12 are not coaxial, the axial direction of ion transmission can be oblique to the axial direction of the ring electrodes 10, 11, and 12.

Figure 2:
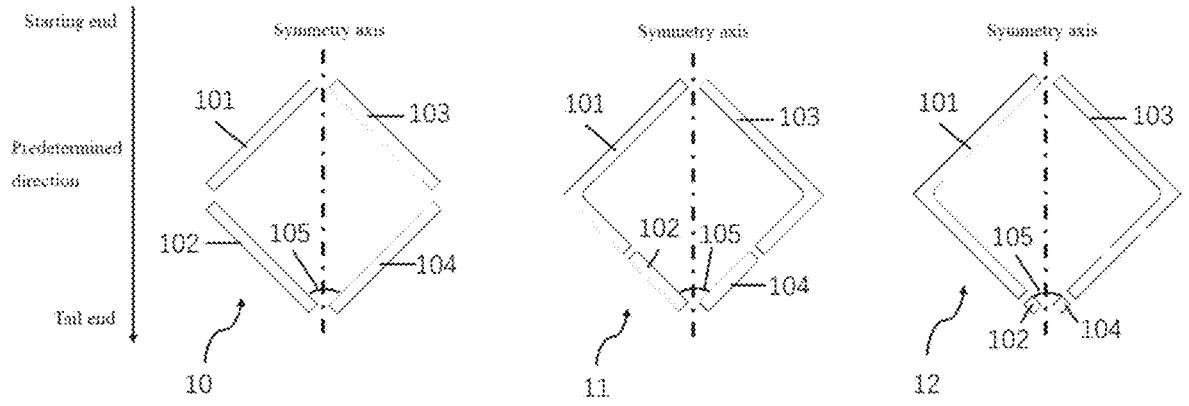
FIG. 2 is a schematic structural view of each ring electrode according to the first embodiment of the present invention.

As shown in FIG. 1 and FIG. 2, lengths of two axisymmetric electrode units 102 and 104 in the ring electrodes 10, 11, and 12 at a tail end of the predetermined direction gradually decrease along an axial direction of the device. In other words, the lengths of the electrode units 102 and 104 near a downstream position are less than or equal to the lengths of the electrode units 102 and 104 near an upstream position along the axial direction. At the same time, lengths of electrode units 101 and 103 at a starting end of the predetermined direction gradually increase along the axial direction of the device. The electrode units 102 and 104 form interior angles 105 of the ring electrodes 10, 11, and 12. Preferably, the interior angle 105 is an inferior angle having an angular size between 30° and 150°.

The ion guide device 1 includes a radio-frequency voltage source and a direct-current voltage source. Adjacent electrode units in each ring electrode 10, 11, and 12 are applied out-of-phase radio-frequency voltages so as to form an radio-frequency quadrupole field for confine ions inside the ring electrodes by using the radio-frequency voltages applied to the adjacent electrode units as described above. A center of the quadrupole field gradually approaches the tail end of the predetermined direction along the axis direction of the device such that the ions are focused near the interior angles 105 of the ring electrodes 10, 11, and 12.

The direct-current voltage source applies direct-current voltages on the ring electrodes 10, 11, and 12, in which the direct-current voltage incudes a first direct-current component distributed in the axial direction to drive the ions to move in the axial direction. In addition, the direct-current voltage further includes a second direct-current voltage, in which amplitude changing in the predetermined direction on planes of the ring electrodes 10, 11, and 12 such that the ions moves away from the axis.

Specifically, the radio-frequency voltage source can cooperate with the direct-current voltage source in a patterned manner. In this operating mode, the out-of-phase radio-frequency voltages applied to adjacent electrode units belonging to the same ring electrode 10, 11, and 12, and a function used to confine the ions inside the channel is mainly provided by this part of out-of-phase radio-frequency voltages. Meanwhile, the in-phase radio-frequency voltages were applied to adjacent electrode units in the axial direction, so that directions of equipotential lines of the radio-frequency quadrupole field are basically in parallel to an axial direction of ion transmission, and the ions move more smoother when transmitted in the axial direction. By applying the radio-frequency voltages in the above-mentioned form, an radio-frequency quadrupole field capable of confine the ions can be formed in the ion guide device 1, so that the ions can stably pass through the ion guide device 1 without leaking from the ring electrodes 10, 11, and 12 or a gap between the ring electrodes 10, 11, and 12.

The direct-current voltage source is used to apply direct-current voltages across the plurality of ring electrodes 10, 11, and 12. The direct-current voltage has a first direct-current component having amplitude that changing in the axial direction, and the first direct-current component is used to drive the ions to move in the axial direction.

The direct-current voltage also includes a second direct-current component having amplitude that changing in the predetermined direction (i.e., a direction from a high potential side to a low potential side in a driving electric field formed by the second direct-current component) along planes of the ring electrodes 10, 11, and 12; the second direct-current component is used to drive the ions for off-axis, especially off-axis movement pointing in the predetermined direction. By means of off-axis transmission, it is possible to avoid forming a gas flow channel directly penetrating the ion guide device 1 in the axial direction, thereby avoiding excessive requirements from the ion guide device 1 for the performance of a vacuum system.

Due to the fact that the radio-frequency quadrupole field is mainly distributed on the inner surfaces of the ring electrodes 10, 11, and 12 and that a pseudo-potential barrier becomes higher when moving closer to the inner surfaces, a balance between the direct-current electric field formed by the second direct-current component and the pseudo-potential barrier formed by the radio-frequency quadrupole field can be utilized to effectively focus the ions to a position closer to the inner surfaces of the ring electrodes 10, 11, and 12, and the first direct-current component can be utilized to stably transmit the ions in the axial direction. Through the above method, the ions are transmitted in an off-axis direction and are focused to a position closer to the inner surfaces of the ring electrodes 10, 11, and 12 under a combined action of the radio-frequency voltages and the direct-current voltages.

In the present embodiment, the direct-current voltage source direct-current and the radio-frequency voltage source radio-frequency can be independently provided separate voltage sources, or can be different modules provided in the same housing, or can be power source components integrated in the same circuit. In other embodiments of the present invention, any other suitable form of power source can also be adopted so long as it is capable of forming an electric field in the form described above, which should also be considered as equivalent implementation of embodiments in the present invention.

In this embodiment, since the same ring electrode 10, 11, and 12 has 4 electrode units, the electrode units 101, 102, 103, and 104 are more densely distributed and spacing between adjacent electrode units becomes shorter as compared to the existing ion guide device 1. Specifically, central angles corresponding to electrode units 102 and 104 at the tail end of the predetermined direction are both less than or equal to $\pi/8$, and are preferably less than $\pi/16$. By applying an radio-frequency quadrupole field on the shorter electrode units 102 and 104, an radio-frequency quadrupole field distributed closer to a surface of the electrode units 102 and 104 can be generated so as to focus the ions in a position close to the electrode units 102 and 104. For example, a balance between the radio-frequency quadrupole field and the second direct-current component can be used to focus the ions near the inner surface of the ring electrode 12. More importantly, since the radio-frequency voltage having different phases which mainly acts as focusing balance is applied to adjacent electrode units of the same ring electrode, an application mode of the radio-frequency quadrupole field can reduce oscillation generated in an ion transmission process compared with applying radio-frequency voltages having different phases to adjacent electrode units in the axial direction, thereby avoiding unexpected dissociation phenomena and improving ion transmission efficiency.

Second Embodiment

Figure 3:
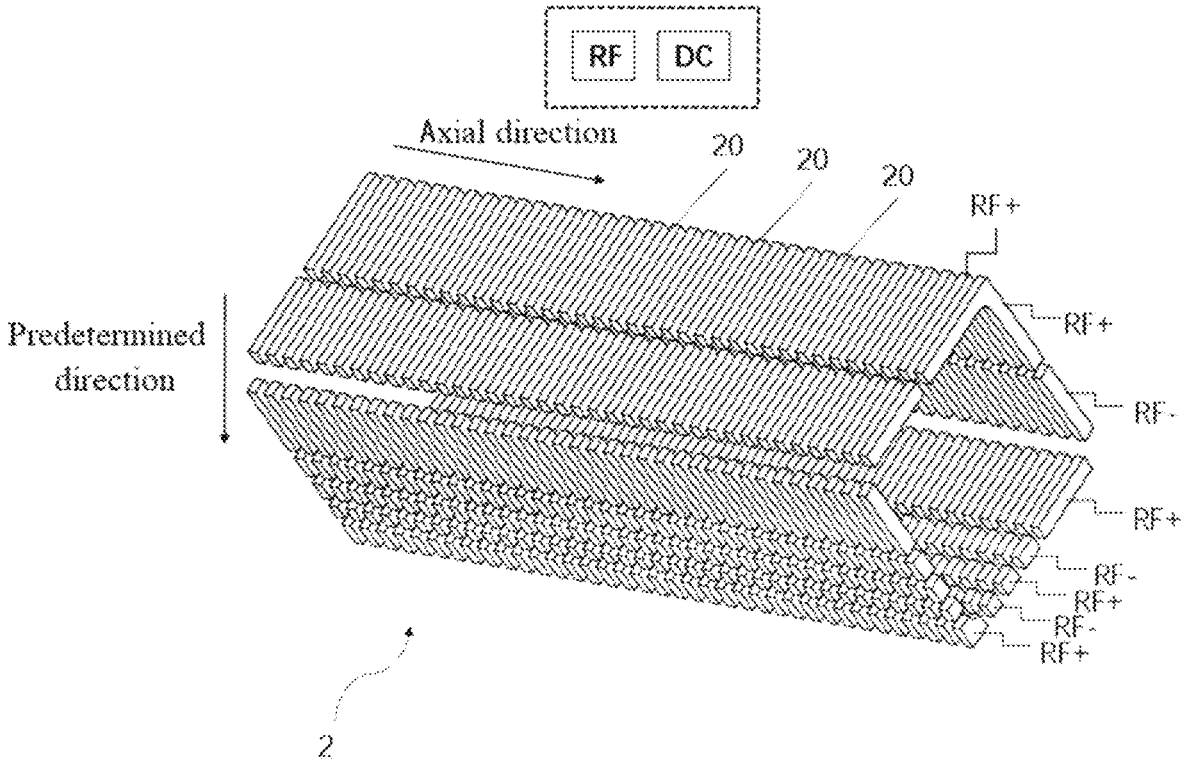
FIG. 3 is a schematic view showing a structure and distribution of ring electrodes of an ion guide device according to a second embodiment of the present invention.
Figure 4:
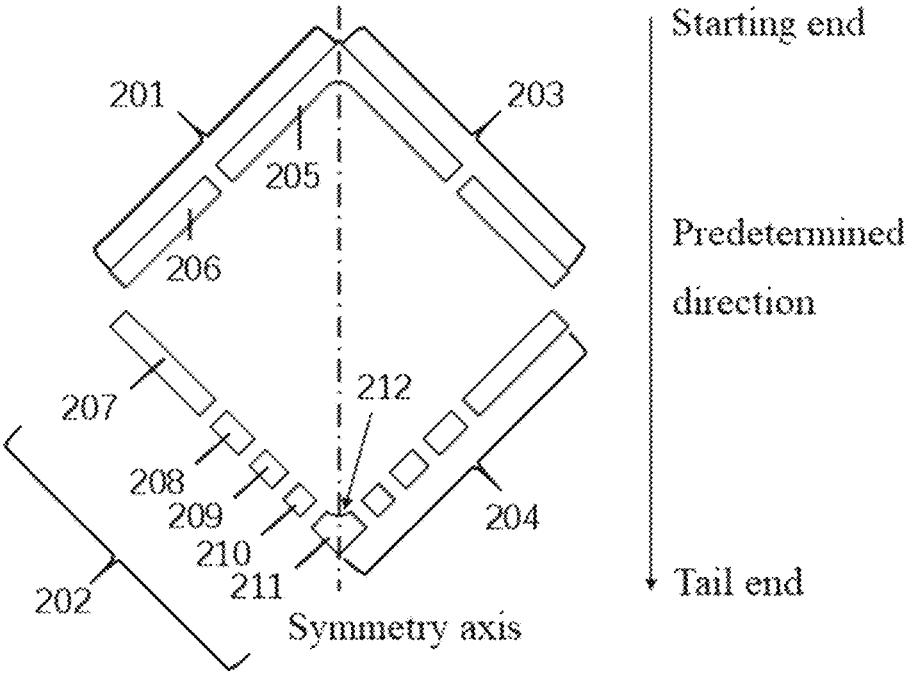
FIG. 4 is a schematic structural view of a cross section of a ring electrode of the ion guide device in FIG. 3.

FIG. 3 is a schematic view showing a structure and distribution of ring electrodes 20 of an ion guide device 2 according to the second embodiment. FIG. 4 is a cross-sectional structure of a ring electrode of the ion guide device 2. The second embodiment includes further improvement based on the first embodiment, and the main improvement includes: The ring electrode 20 has a different shape and segmented structure in the second embodiment as compared to the first embodiment.

Referring to FIG. 3 and FIG. 4, each ring electrode 20 has a square shape (or rhombus shape) as a whole, and the segmented structure of the ring electrode 20 is axisymmetric along a diagonal line of the square. The diagonal line as a symmetry axis is a diagonal line extending in the predetermined direction. On one side of the symmetry axis, the ring electrode includes a first side 201 and a second side 202, while on the other side of the symmetry axis, the ring electrode includes a third side 203 and a fourth side 204. Segmented structures of the first side 201 and the third side 203 are symmetrical with each other, and segmented structures of the second side 202 and the fourth side 204 are symmetrical with each other. The first side 201 and the third side 203 are respectively divided into two separate electrode segments each basically occupying ½ of a side length (basically corresponding to a $\pi/8$ central angle), and one electrode segment of the first side 201 and one electrode segment of the third side 203 are connected to each other at a corner so as to form an integrated electrode unit 205 having the corner.

Both the second side 202 and the fourth side 204 are segmented in a non-uniform manner, and the segmented structures are symmetrical with each other along the predetermined symmetry axis. Both the second side 202 and the fourth side 204 include an electrode unit 207 each occupying ½ of a side length (basically corresponding to a $\pi/8$ central angle). By applying radio-frequency voltages having different (especially opposite) phases, the electrode unit 207 and an electrode unit 206 that is provided by the first side 201 and the third side 203 and basically has the same length with the electrode unit 207 can effectively form a medium-long range of ion confining effects so as to drive the ions to focus toward a position near the symmetry axis.

The second side 202 and the fourth side 204 also include electrode units 208, 209, and 210 whose lengths gradually decrease in the predetermined direction. These electrode units, such as the electrode units 208, 209, and 210, are all provided at a bottom of the ring electrode 20, that is, the tail end of the ring electrode 20 in the predetermined direction. Since the electrode units 208, 209, and 210 have shorter lengths and smaller spacing, the radio-frequency voltages applied to the electrode units 208, 209, and 210 having shorter lengths and smaller spacing can generate an radio-frequency multipole field that confine the ions in a position close to the inner surface of the ring electrode 20. In this embodiment, as the lengths of the electrode units 208, 209, and 210 become shorter, an ion beam is bound at a position near the symmetry axis and the ions are moved and focused to a position close to the inner surface of the ring electrode 20 basically along a path where the symmetry axis is located by utilizing the characteristics that the second side 202 and the fourth side 204 gradually narrow in the predetermined direction.

In this embodiment, in addition to the electrode unit 211 at the corner, compression performance of the electrode units 206 to 210 toward the ion beam can be adaptively set by configuring the lengths of each electrode unit (including the electrode units 206 to 210) of the ring electrode 20 to gradually decrease in the predetermined direction. The electrode units 206 and 207 closer to the starting end in the predetermined direction tend to have longer lengths, and can generate medium-long range repulsion, which keeps the ions at positions close to the symmetry axis of the ring electrode 20 so as to facilitate performing further compression and focusing on the ion beam by pushing the ions from both sides to the middle. The electrode units 209 and 210 closer to the tail end in the predetermined direction tend to have shorter lengths, and the shorter electrode units 209 and 210 can confine the ions in a close vicinity so as to compress the ion beam to a smaller size and improve the transmission performance of the ion beam by pushing the ions from both sides to the middle.

In the present embodiment, the tail end of the ring electrode 20 in the predetermined direction is configured as an interior angle 212 of the ring electrode 20, and the radio-frequency multipole field formed by both sides of the interior angle 212 or the electrode units 210 on both sides of the interior angle can be used to further compress the ion beam and improve a focusing effect of the ion beam by focusing the ion beam toward the interior angle 212.

In some embodiments, the predetermined direction can be specified as pointing to the electrode units rather than pointing to gaps between the electrode units in order to further prevent the ion beam from leaking out of the gap between adjacent electrode units. In the present embodiment, the predetermined direction is parallel to the symmetry axis of the square (or rhombic) ring electrode 20. Specifically, in the present embodiment, the electrode unit to which the second direct-current component directly points is the electrode unit 211 in the predetermined direction. The electrode unit 211 is the electrode unit 211 located at the interior angle 212 of the ring electrode 20.

The electrode unit at the interior angle 212 is on a path approaching the interior angle 212 along the predetermined direction, the electrode units 207, 208, 209, and 210 on both sides of the path form a gradually narrowed shape that can gradually compress the ion beam. In other words, this shape can gradually shrink a cross-sectional size of the ion beam, thereby improving the transmission performance of the ion beam. Preferably, the interior angle 212 is an inferior angle having an angular size between 30° and 150°.

A size of the interior angle 212 as a focusing target should not be too large or too small. Since a large interior angle 212 easily leads to reduced compression performance of the ion beam while a small interior angle 212 is difficult to perform stable off-axis transmission on the ion beam to a preset ion outlet position, the interior angle 212 is set as 30° to 150°, which can effectively take the above problems into account.

In addition, in order to enable the adjacent electrode units of the ring electrode 20 to be applied the out-of-phase radio-frequency voltages, the number of electrode units separated from a single ring electrode 20 is preferably an even number. Preferably, the ring electrode 20 has an axisymmetric structure, and the symmetry axis thereof is parallel to a straight line where a vector of the predetermined direction is located. The ring electrode 20 in an axisymmetric structure facilitates the generation of an radio-frequency multipole field that causes the ion beam to converge toward the symmetry axis and reduces complexity for simulation and calculation of the electric field.

In the present embodiment, the plurality of ring electrodes 20 have the same shape and size. Uniform structure and size of each ring electrode 20 can facilitate manufacturing the ring electrode 20 and applying voltages.

Figure 5:
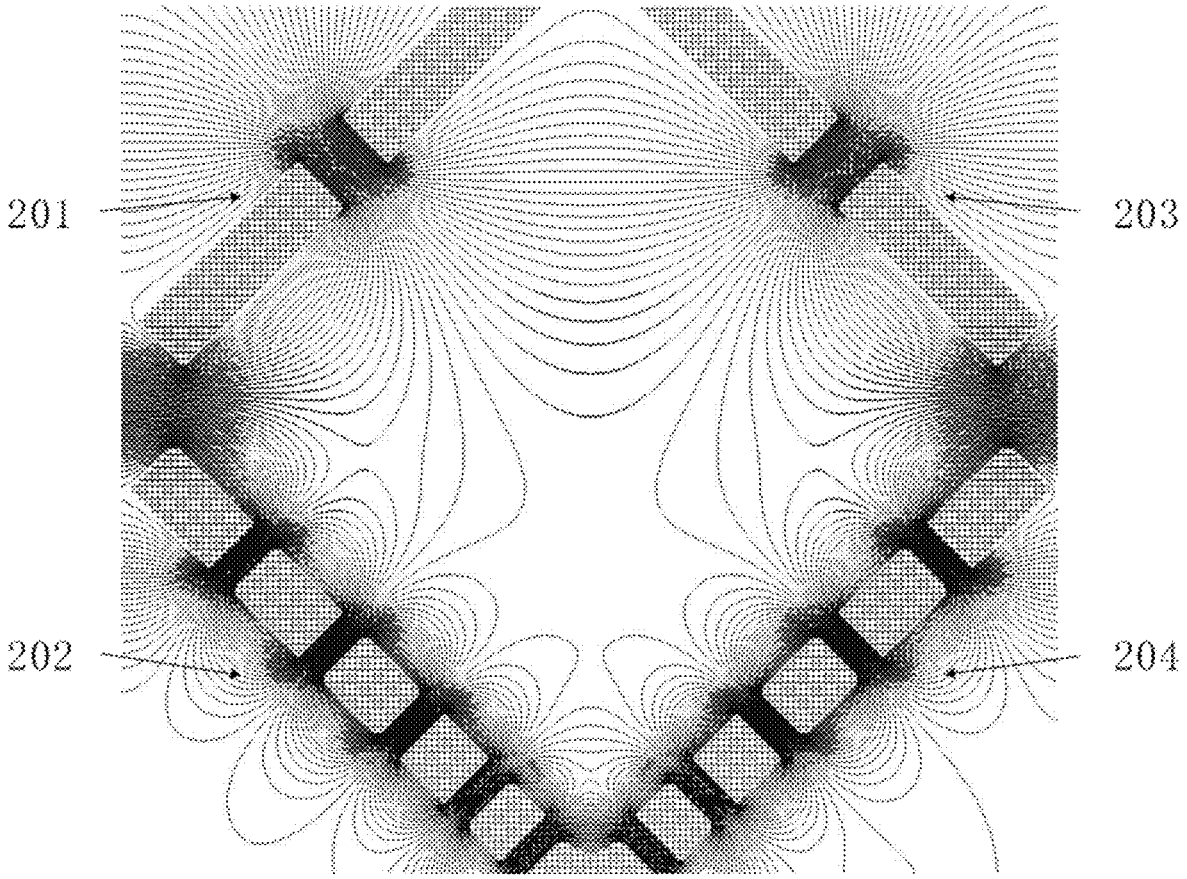
FIG. 5 shows distribution (simulation result) of an radio-frequency multipole field formed by an radio-frequency voltage source around the ring electrode of the ion guide device according to the second embodiment.
Figure 6:
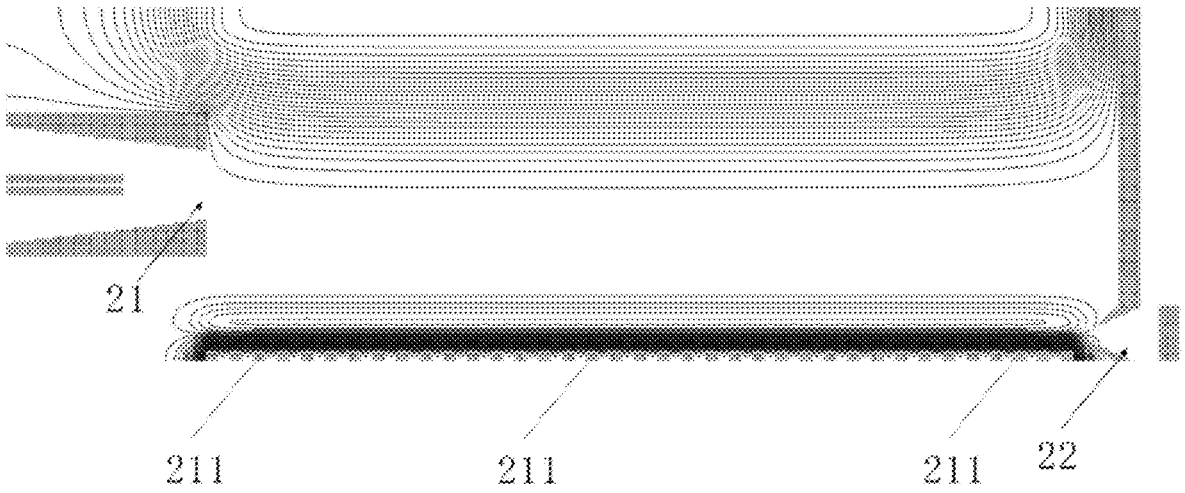
FIG. 6 shows distribution (simulation result) of the radio-frequency multipole field formed by the radio-frequency voltage source along an axial direction of the ion guide device according to the second embodiment.

Simulation Results:

FIG. 5 shows distribution of an radio-frequency multipole field formed by an radio-frequency voltage source around the ring electrode of the ion guide device 2. FIG. 6 shows distribution of the radio-frequency multipole field formed by the radio-frequency voltage source along the axial direction of the ion guide device 2.

As can be seen in FIG. 5, the radio-frequency electrode field has a weaker electric field intensity at the center of the ring electrode 20. When the ions move to positions closer to the electrode units, the ions are affected by a repelling force generated by the radio-frequency multipole field on the surface of the electrode units and are kept inside the ion guide device 2. Specifically, the distribution of the radio-frequency multipole field applied to the axisymmetric ring electrode 20 is also axisymmetric; the ion beam gradually approaches the electrode unit 211 in a downward manner while in a way of being basically kept on the axis of the symmetry axis, finally focuses on an area between the electrode unit 211 and two electrode units 210, and stably focuses on the inner side of the ion guide device 2 through a balance between repelling forces formed by the electrode unit 211, the two electrode units 210 and the second direct-current component.

Referring to FIG. 6, it should be noted that, in the present embodiment, an ion inlet 21 of the ion guide device 2 is provided on a central axis distributed with the plurality of ring electrodes 20, while an ion outlet 22 of the ion guide device 2 is provided away from the central axis of the ring electrode 20. Specifically, the set position of the ion outlet 22 corresponds to the inner surface of the ring electrode 20 at the tail end of the predetermined direction. In other embodiments of the present invention, positions of the ion inlet 21 and the ion outlet 22 on a radial plane can also be adjusted according to actual needs.

Referring to the distribution of the radio-frequency multipole field in FIG. 6, the radio-frequency multipole field extends in the axial direction inside the plurality of ring electrodes 20 in the present embodiment. With this arrangement, the ion transmission process in the axial direction is relatively smooth, which can more effectively mitigate an oscillation heating problem in the ion transmission process.

Figure 7:
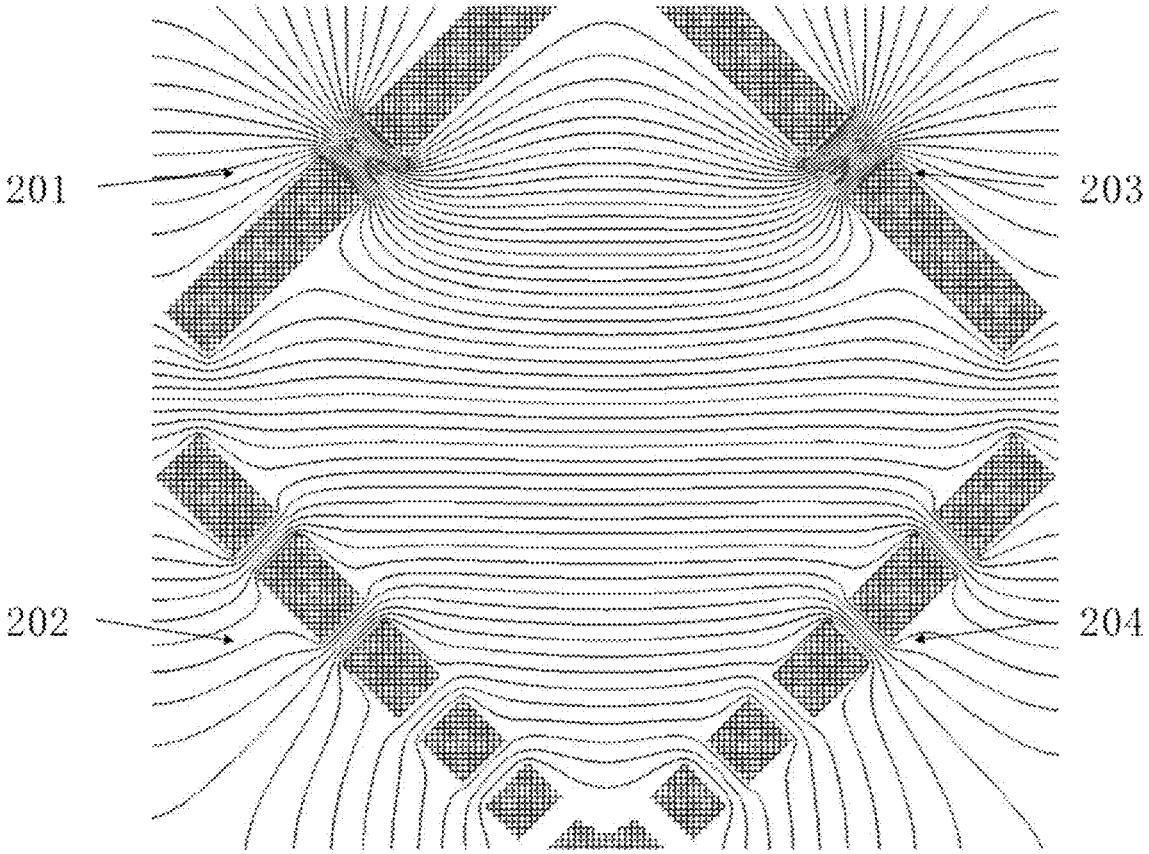
FIG. 7 shows distribution (simulation result) of a direct-current electric field formed by a direct-current voltage source around the ring electrode of the ion guide device according to the second embodiment.
Figure 8:
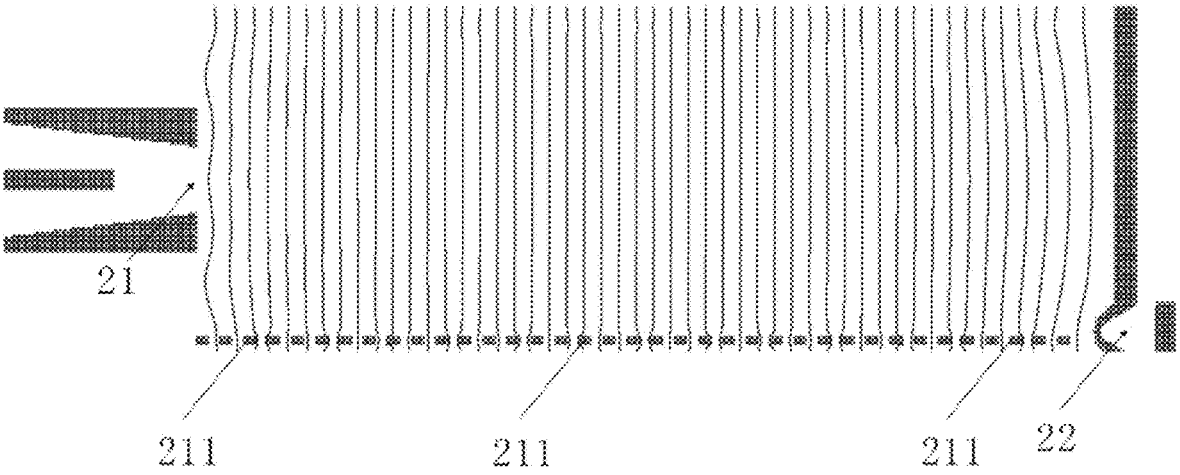
FIG. 8 shows distribution (simulation result) of the direct-current electric field formed by the direct-current voltage source along the axial direction of the ion guide device according to the second embodiment.

FIG. 7 shows distribution of the direct-current electric field formed by the direct-current voltage source around the ring electrode 20 of the ion guide device 2. FIG. 8 shows distribution of the direct-current electric field formed by the direct-current voltage source along the axial direction of the ion guide device 2.

Referring to FIG. 7, the direct-current electric field generated by the second direct-current component is distributed along the plane of the ring electrode 20. The distribution of the direct-current electric field in the predetermined direction is basically uniform, and a top of the ring electrode 20 in FIG. 7 is the high potential side and the bottom is the low potential side. The ions in the ion guide device 2 are subjected to a basically uniform electric field force of the second direct-current component toward the bottom, and thus the ions move toward the inner side of the bottom of the ring electrode 20 under the drive of the electric field force.

Referring to FIG. 8, the direct-current electric field formed by the first direct-current component is distributed in the axial direction, thereby forming an electrical potential gradient in the axial direction. Equipotential lines, formed by the first direct-current component, of the direct-current electric field are basically distributed in a uniform manner, in which the ion inlet 21 of the ion guide device 2 is located at the high potential side while the ion outlet 22 is located at the low potential side. The ions in the ion guide device 2 are subjected to a basically uniform electric field force of the first direct-current component toward the ion outlet, and thus the ions axially move toward the ion outlet under the drive of the electric field force and generate deflection toward the off-axis ion outlet 22 under the action of the second direct-current component.

Figure 9:
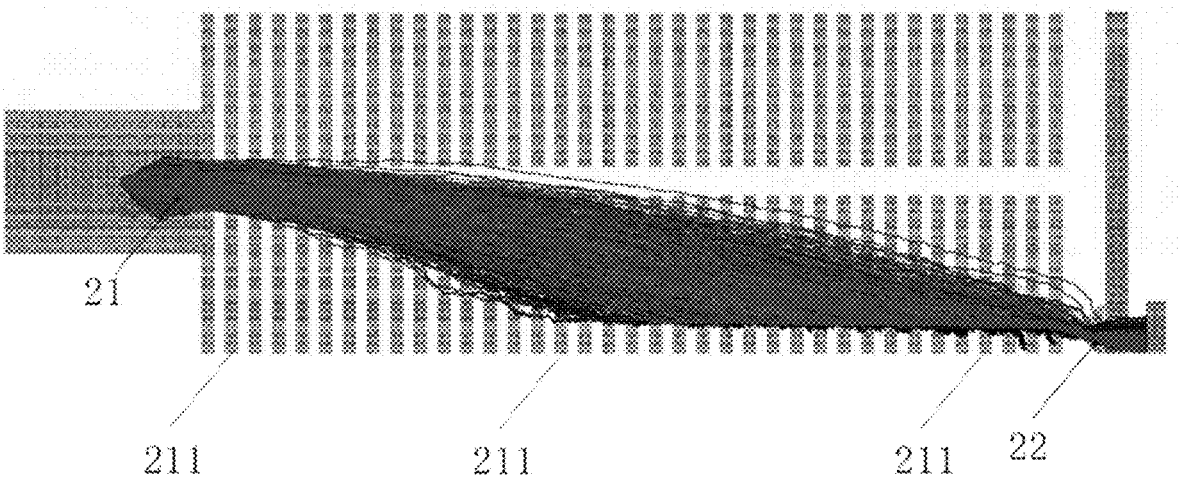
FIG. 9 is a schematic view of travel trajectories (simulation result) for ions in the ion guide device according to the second embodiment.

FIG. 9 is a schematic view of travel trajectories for the ions in the ion guide device 2. In FIG. 9, the ions move axially toward the ion outlet from the ion inlet under the drive of the electric field force, generate deflection toward the off-axis ion outlet 22 under the action of the second direct-current component, and are finally focused on the inner side of the bottom of the ion guide device 2 so as to flow out of the ion outlet 22. The travel trajectories of the ions can be adjusted using the direct-current voltage source and parameters (e.g., amplitude, phase) of the radio-frequency voltage source. In some embodiments, adjustment of the amplitude can be utilized to ensure that basically all types of ions can be effectively focused to a position close to the inner side of the bottom of the ion guide device 2. In other embodiments, adjustment of the amplitude can also be utilized to screen out some ions to be focused and flowed out.

Figure 10:
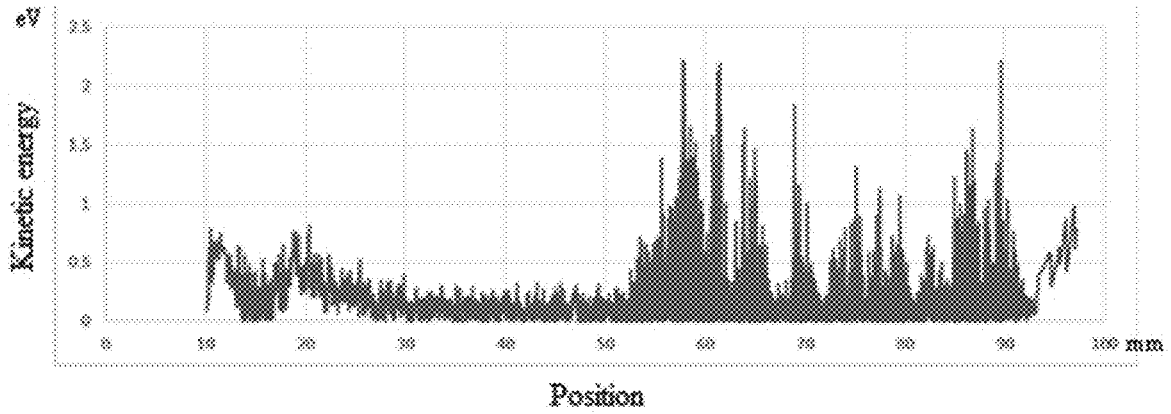
FIG. 10 shows kinetic distribution (simulation result) of the ions when moving in the axial direction according to the second embodiment.

FIG. 10 further shows kinetic distribution of the ions when moving in the axial direction. An X axis in FIG. 10 shows positions of the ions in the axial direction, and a Y axis in FIG. 10 shows amplitudes of kinetic energy. Referring to FIG. 10, a change in kinetic energy of the ions during the whole axial movement is small, which is basically below 2 eV, and thus the simulation result further verifies that the ion guide device 2 effectively solves the oscillation heating problem of the ions in the axial direction.

Third Embodiment

Figure 11:
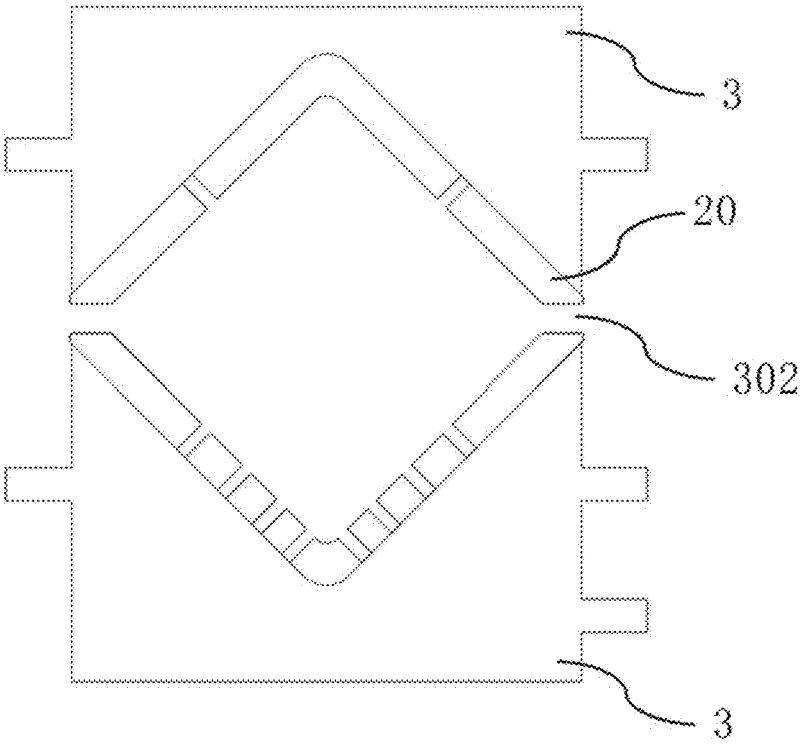
FIG. 11 is a schematic structural view of a circuit board provided with a ring electrode according to a third embodiment.

FIG. 11 is a schematic structural view of a circuit board 3 provided with the ring electrode 20. The third embodiment includes a further improvement based on the second embodiment. The main improvement includes that the ring electrode 20 is a metal portion manufactured on the circuit board in the third embodiment.

Using the circuit board structure to manufacture and assemble the ion guide device can conveniently and regularly reserve wiring for each electrode unit; and a circuit board process or a golden finger process is mature and can be used to obtain a smooth electrode unit with an uniform thickness, thereby improving uniformity of the formed electric field.

In this embodiment, each ring electrode 20 is manufactured on one or more circuit boards 3, specifically two circuit boards 3. By assembling a plurality of circuit boards 3 to obtain the ring electrode 20, the circuit board structure in some positions can be omitted so as to save materials. When the ring electrode is assembled by two circuit boards 3, a gap is left between the two circuit boards and is configured as a gap 302 for gas circulation. In manufacturing or assembling the circuit board, a path is provided for the gas circulation by reserving the gap 302, and this configuration can allow the ion guide device 2 to have a more compact and regular structure.

Fourth Embodiment

Figure 12:
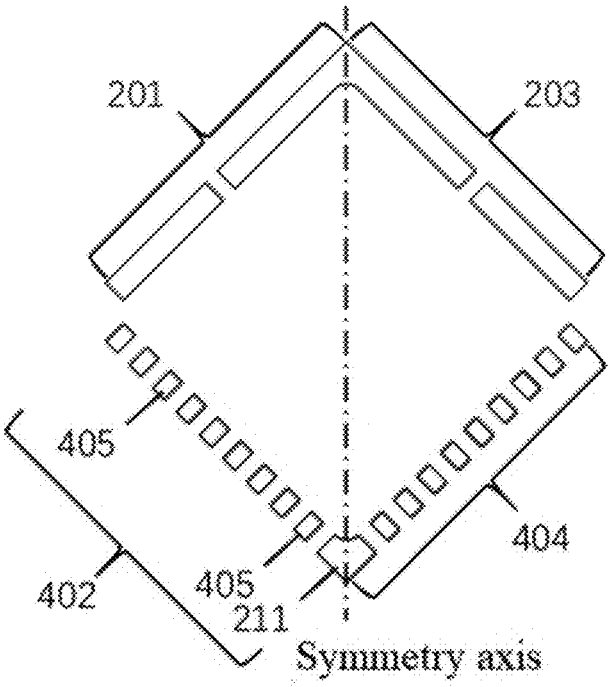
FIG. 12 is a schematic structural view of a ring electrode according to a fourth embodiment.

FIG. 12 is a schematic structural view of a ring electrode 40 according to the fourth embodiment. The fourth embodiment provides a modified example of the ring electrode 40. The main improvement includes that: in the fourth embodiment, the second side 402 and the fourth side 404 of the ring electrode 40 are composed of electrode units 405 with the same length; other parts are the same as in the second embodiment, and the parts using the same reference numerals are identical.

Referring to FIG. 12, both the second side 402 and the fourth side 404 of the ring electrode 40 have a plurality of electrode units 405 with the same length, the number of electrode units 405 on the second side 402 is the same as that on the fourth side 404, and the segmented structures of the second side 402 and the fourth side 404 are mirror images of each other about the symmetry axis. Using electrode units 405 with the same length to form the ring electrode, on the one hand, can improve the universality of production and assembly of ring electrode components, and on the other hand, can also simplify simulation or calculation of the electric field to be applied.

All the ring electrodes 20 and 40 in the second to fourth embodiments have a polygonal outer ring outline (e.g., square, rhombus), but the structure of ring electrode in the embodiments of the present invention is not limited thereto. In some embodiments, a circular, oval, or other suitable curvilinear type of ring electrode can also be used, or a ring electrode formed by a combined use of curves and straight lines. For example, the ring electrode can be configured in a structure in which an upper portion uses a circular ring while a lower portion uses a linear electrode.

Figure 13:
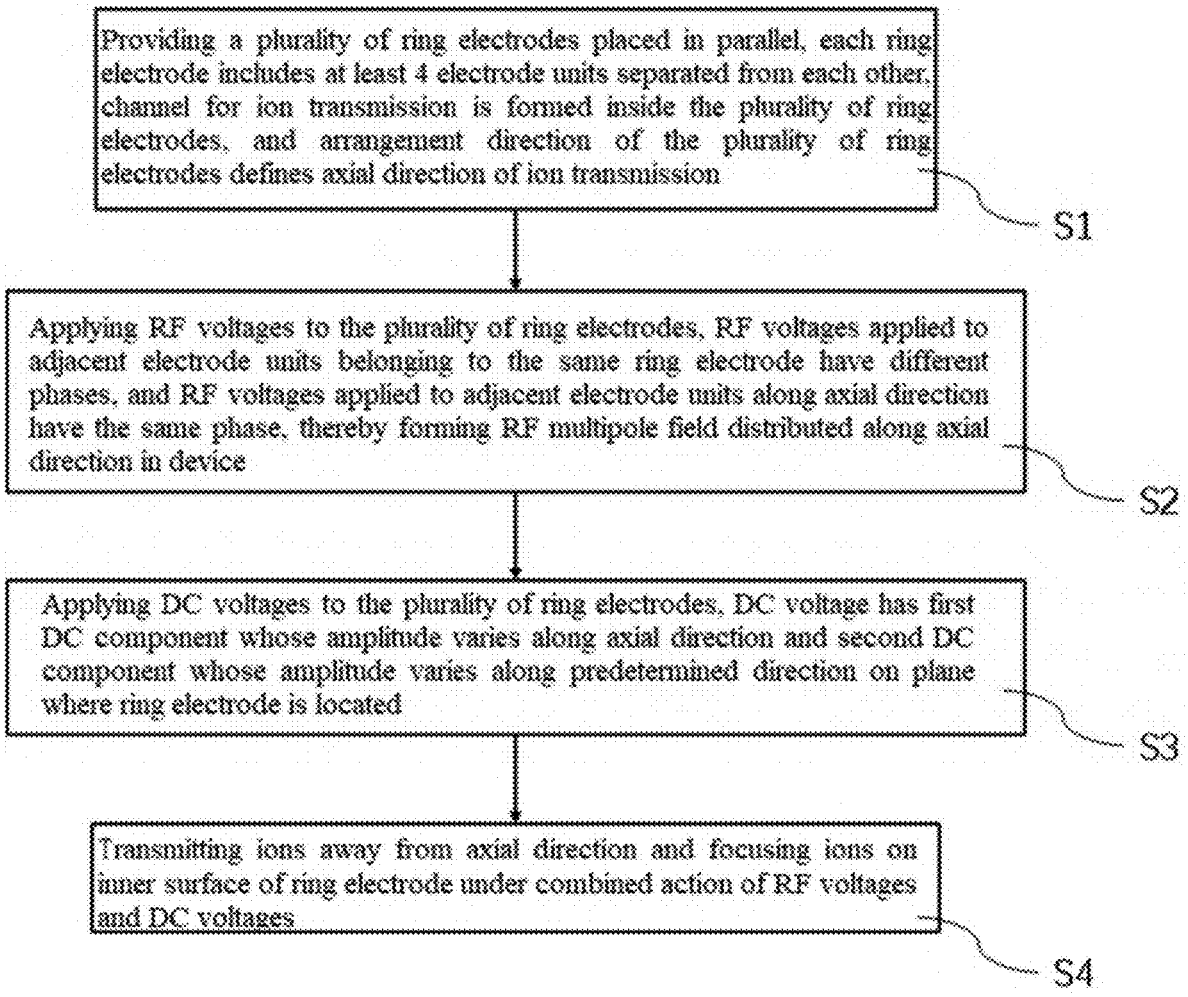
FIG. 13 is a flowchart of an ion guide method according to embodiments of the present invention.

According to the first to fourth embodiments, the present invention further provides an ion guide method, which is provided in the embodiment in FIG. 13 and includes the following steps:

S1, providing a plurality of ring electrodes placed in parallel, each of the ring electrodes includes at least 4 electrode units separated from each other, a channel for ion transmission is formed inside the plurality of ring electrodes, and an arrangement direction of the plurality of ring electrodes defines an axial direction of ion transmission;

S2: applying radio-frequency voltages to the plurality of ring electrodes, applying out-of-phase radio-frequency voltages to adjacent electrode units belonging to the same ring electrode, and applying in-phase radio-frequency voltages to adjacent electrode units along the axial direction, thereby forming an radio-frequency multipole field distributed along the axial direction in a device;

S3, applying direct-current voltages to the plurality of ring electrodes, a direct-current voltage has a first direct-current component whose amplitude changing along the axial direction and a second direct-current component whose amplitude changing along a predetermined direction on a plane where a ring electrode is located; and S4, transmitting ions off-axis and focusing the ions to a position close to an inner surface of the ring electrode under a combined action of the radio-frequency voltages and the direct-current voltages.

By adopting the above ion guide method, the oscillation generated in the ion transmission process can be reduced, thereby avoiding unexpected dissociation phenomena and improving the ion transmission efficiency.

It can be appreciated by those skilled in the art that in the various embodiments described above, many technical details are provided for the reader to better understand the present application. However, even without these technical details and variations and modifications based on the embodiments described above, the technical embodiments as claimed in claims of the present application may basically be realized. Therefore, in practical applications, various changes may be made to the embodiments described above in form and detail without departing from the spirit and scope of the present invention.

What is claimed is:

1. An ion guide device, comprising:

a plurality of ring electrodes disposed in parallel, each of the ring electrodes includes at least 4 electrode units separated from each other, a channel for ion transmission is formed inside the plurality of ring electrodes, and an arrangement direction of the plurality of ring electrodes defines an axial direction of ion transmission;

a radio-frequency voltage source, for applying out-of-phase radio-frequency voltages on the neighboring electrode units belonging to the same ring electrode, and applying in-phase radio frequency voltages on the neighboring electrode units along the axial direction, thereby forming an radio-frequency multipole field that confine ions in the ion guide device; and a direct-current voltage source, for applying a direct-current voltage on the plurality of ring electrodes, a direct-current voltage has a first direct-current component whose amplitude changing along the axial direction and a second direct-current component whose amplitude changing along a predetermined direction on a plane where a ring electrode is located, wherein the ions are transmitted off-axis and focused to a position closer to an inner surface of the ring electrode under a combined action of the radio-frequency voltages and the direct-current voltages.

2. The ion guide device according to claim 1, wherein a shape of the ring electrode has at least one interior angle and the predetermined direction is pointed to the interior angle.

3. The ion guide device according to claim 2, wherein the interior angle is an inferior angle of 30° to 150°.

4. The ion guide device according to claim 1, wherein the radio-frequency multipole field extends in the axial direction inside the plurality of ring electrodes.

5. The ion guide device according to claim 1, wherein the ring electrode has a plurality of electrode units with the same length.

6. The ion guide device according to claim 1, wherein a length of each of the electrode units of each of the ring electrodes gradually decreases in the predetermined direction.

7. The ion guide device according to claim 1, wherein the plurality of ring electrodes have the same shape and size.

8. The ion guide device according to claim 1, wherein the ring electrode is a metal portion manufactured on a circuit board.

9. The ion guide device according to claim 8, wherein each of the ring electrodes is manufactured on one or more circuit boards.

10. The ion guide device according to claim 8, wherein the circuit board includes at least one gap and the gap is used for gas circulation.

11. An ion guide method, comprising the steps of:

providing a plurality of ring electrodes disposed in parallel, each of the ring electrodes includes at least 4 electrode units separated from each other, a channel for ion transmission is formed inside the plurality of ring electrodes, and an arrangement direction of the plurality of ring electrodes defines an axial direction of ion transmission;

applying out-of-phase radio-frequency voltages on the neighboring electrode units belonging to the same ring electrode, and applying in-phase radio frequency voltages on the neighboring electrode units along the axial direction, thereby forming an radio-frequency multipole field distributed along the axial direction in a device;

applying direct-current voltages to the plurality of ring electrodes, a direct-current voltage has a first direct-current component whose amplitude changing along the axial direction and a second direct-current component whose amplitude changing along a predetermined direction on a plane where a ring electrode is located; and transmitting ions off-axis and focusing the ions to a position closer to an inner surface of the ring electrode under a combined action of the radio-frequency voltages and the direct-current voltages.

12. An ion guide device, comprising:

a plurality of ring electrodes disposed in parallel, each of the ring electrodes includes at least 4 electrode units separated from each other, a channel for ion transmission is formed inside the plurality of ring electrodes, and an arrangement direction of the plurality of ring electrodes defines an axial direction of ion transmission;

an radio-frequency voltage source, for applying out-of-phase radio-frequency voltages on the neighboring electrode units belonging to the same ring electrode, and applying in-phase radio frequency voltages on the neighboring electrode units along the axial direction, thereby forming an radio-frequency multipole field that confine ions in the ion guide device; and a direct-current voltage source, which is used to apply direct-current voltages on the plurality of ring electrodes, a direct-current voltage has a second direct-current component whose amplitude changing along a predetermined direction on a plane where a ring electrode is located, so that the ions are deflected toward the electrode units directed in the predetermined direction, wherein central angles between the electrode units directed in the predetermined direction and the adjacent electrode units are both less than or equal to $\pi/8$.

13. The ion guide device according to claim 12, wherein the central angles of the electrode units directed in the predetermined direction and the adjacent electrode units are both less than or equal to $\pi/16$.

* * * * *